US009850872B2

(12) United States Patent
Ruth et al.

(10) Patent No.: US 9,850,872 B2
(45) Date of Patent: Dec. 26, 2017

(54) SYSTEM AND METHOD FOR ADJUSTING ON-TIME CALIBRATION OF A FUEL INJECTOR IN INTERNAL COMBUSTION ENGINE

(71) Applicant: Cummins Inc., Columbus, IN (US)

(72) Inventors: Michael J. Ruth, Franklin, IN (US); Michael J. Cunningham, Greenwood, IN (US)

(73) Assignee: Cummins Inc., Columbus, IN (US)

( * ) Notice: Subject to any disclaimer, the term of this patent is extended or adjusted under 35 U.S.C. 154(b) by 282 days.

(21) Appl. No.: 14/460,669

(22) Filed: Aug. 15, 2014

(65) Prior Publication Data

US 2015/0053184 A1 Feb. 26, 2015

Related U.S. Application Data

(60) Provisional application No. 61/867,893, filed on Aug. 20, 2013.

(51) Int. Cl.

| | |
|---|---|
| ***F02M 51/00*** | (2006.01) |
| ***F02M 65/00*** | (2006.01) |
| ***F02M 63/02*** | (2006.01) |
| ***F02D 41/24*** | (2006.01) |
| *F02D 41/32* | (2006.01) |
| *F02B 1/04* | (2006.01) |
| *F02D 41/34* | (2006.01) |
| *F02D 41/04* | (2006.01) |

(52) U.S. Cl.

CPC ..... *F02M 65/001* (2013.01); *F02D 41/2467* (2013.01); *F02M 63/0225* (2013.01); *F02B 1/04* (2013.01); *F02D 41/04* (2013.01); *F02D 41/042* (2013.01); *F02D 41/32* (2013.01); *F02D 41/34* (2013.01); *F02D 41/345* (2013.01); *F02D 2200/0602* (2013.01); *F02D 2200/0614* (2013.01); *F02M 2200/8092* (2013.01)

(58) Field of Classification Search

CPC ..... F02D 41/32; F02D 41/345; F02D 41/04; F02D 41/34; F02B 1/04

USPC ..... 123/478

See application file for complete search history.

(56) References Cited

U.S. PATENT DOCUMENTS

| | | | |
|---|---|---|---|
| 5,633,458 | A | 5/1997 | Pauli et al. |
| 6,557,530 | B1 | 5/2003 | Benson et al. |
| 6,904,354 | B2 | 6/2005 | Kuegel et al. |
| 6,964,261 | B2 | 11/2005 | Warne et al. |
| 7,392,792 | B2 | 7/2008 | Puckett |

(Continued)

FOREIGN PATENT DOCUMENTS

| | | | |
|---|---|---|---|
| JP | 2008248792 | A | * 10/2008 |
| JP | 2008248792 | A | * 10/2008 |

*Primary Examiner* — Jacob Amick
*Assistant Examiner* — Charles Brauch
(74) *Attorney, Agent, or Firm* — Faegre Baker Daniels LLP

(57) ABSTRACT

The disclosure provides a system and method for determining an amount of fuel injected or delivered by a single fuel injector in an internal combustion engine by generating one fuel injection event after the engine has stopped operating. The fuel delivered is statistically analyzed in comparison with a commanded fuel delivery amounts to determine the suitability of fuel injector on-time calibration for the analyzed fuel injector. If the fuel delivered deviates from the commanded amount of fuel delivery by a predetermined value, the fuel injector on-time calibration for the analyzed fuel injector is changed.

24 Claims, 4 Drawing Sheets

(56) References Cited

U.S. PATENT DOCUMENTS

| | | | | |
|---|---|---|---|---|
| 7,523,743 | B1 | 4/2009 | Geveci et al. | |
| 7,556,023 | B2 | 7/2009 | Ilhoshi et al. | |
| 7,558,665 | B1 | 7/2009 | Geveci et al. | |
| 7,717,088 | B2 | 5/2010 | Thomas | |
| 7,765,054 | B2 | 7/2010 | Jung et al. | |
| 7,788,015 | B2 | 8/2010 | Geveci et al. | |
| 7,841,319 | B2 | 11/2010 | Thomas | |
| 7,891,339 | B2 | 2/2011 | Takahashi et al. | |
| 7,945,372 | B2 | 5/2011 | Geveci et al. | |
| 8,015,963 | B2 | 9/2011 | Elkolaly | |
| 2003/0075155 | A1* | 4/2003 | Frech | F02D 41/062 123/491 |
| 2004/0200456 | A1* | 10/2004 | Eser | F02D 41/221 123/458 |
| 2005/0061299 | A1* | 3/2005 | Leman | F02D 41/2467 123/486 |
| 2009/0271090 | A1* | 10/2009 | Surnilla | F02D 19/0628 701/103 |
| 2011/0000463 | A1* | 1/2011 | Kokotovic | F02D 41/042 123/457 |
| 2011/0231082 | A1* | 9/2011 | Saruwatari | F02D 41/0042 701/104 |

* cited by examiner

SYSTEM AND METHOD FOR ADJUSTING ON-TIME CALIBRATION OF A FUEL INJECTOR IN INTERNAL COMBUSTION ENGINE

CROSS-REFERENCE TO RELATED APPLICATION

This application claims the benefit of U.S. Provisional Patent Application No. 61/867,893, filed Aug. 20, 2013, which is incorporated by reference herein in its entirety for all purposes.

TECHNICAL FIELD

This disclosure relates to a system and method for determining the amount of fuel provided by a fuel injector to a combustion chamber of an internal combustion engine and adjusting an on-time calibration of the fuel injector in response to the measured amount of fuel.

BACKGROUND

A fuel injector of an internal combustion engine is affected by wear, environmental conditions, and other factors. When a fuel injector is initially tested and assembled into an internal combustion engine, a control system of the engine is provided with calibration values that provide for optimal operation of the fuel injector, such as the amount of fuel delivered for an injector on-time. As the fuel injector's performance changes with time, the original calibration values may lead to less than optimal performance for the fuel injector.

SUMMARY

Various embodiments of the disclosure relate to a method of calibrating fuel injectors. The method comprises receiving an engine shutdown value; providing a fuel injection value to initiate a fuel injection event for a fuel injector corresponding to a cylinder in response to the engine shutdown value; receiving a pressure value representing a fuel pressure over a period of time, which includes the fuel injection event; calculating an amount of fuel actually injected in response to the pressure value; producing a deviation value in response to the amount of fuel and a commanded amount of fuel; and determining a correction factor for the injector in response to the deviation value. In some embodiments, the fuel injection value is provided while sufficient pressure remains in the fuel accumulator to permit proper functioning of the fuel injector. The method may further comprise operating the fuel injector in response to the correction factor.

In some embodiments, the deviation value may be determined in response to a trend analysis including the amount of fuel delivered and a previous amount of fuel delivered. In yet other embodiments, the correction factor is determined in response to a statistical analysis of fuel injection events.

Various other embodiments relate to a control system, comprising a memory configured to store a commanded amount of fuel for a fuel injector corresponding to a cylinder and an analysis module coupled to the memory. The analysis module is configured to detect an engine shutdown value; determine a deviation value in response to the commanded amount of fuel and an amount of fuel delivered; and determine a correction factor in response to the deviation value.

The controls system may include a correction module coupled to the analysis module and configured to receive the correction factor; produce a modified on-time calibration for the fuel injector; and provide a calibration value representing the modified on-time calibration to a corresponding lookup table.

In some embodiments, a calculation module is coupled to the analysis module and configured to receive pressure information directly or indirectly from an accumulator pressure sensor; calculate an amount of fuel delivered by the fuel injector to the cylinder; and provide the amount of fuel.

In yet other embodiments, a fuel injection module is coupled to the calculation module and a set of fuel injectors corresponding to a set of cylinders. The fuel injection module is configured to receive sensor information, including piston position information; determine the cylinder for receiving fuel in response to the piston position information; and provide a fuel injection value to the fuel injector corresponding to the cylinder.

Various embodiments also relate to an engine system. The engine system includes an engine block having a set of cylinders; a fuel injection system including a fuel pump, a fuel accumulator, and a set of fuel injectors in fluid communication with the fuel accumulator, each fuel injector configured to inject fuel into a corresponding cylinder; and means for adjusting an on-time value of a fuel injector in response to a deviation between an amount of fuel and a commanded amount of fuel, wherein error in the amount of fuel caused by an operating fuel pump is mitigated.

Advantages and features of the embodiments of this disclosure will become more apparent from the following detailed description of exemplary embodiments when viewed in conjunction with the accompanying drawings.

DETAILED DESCRIPTION

Figure 1:
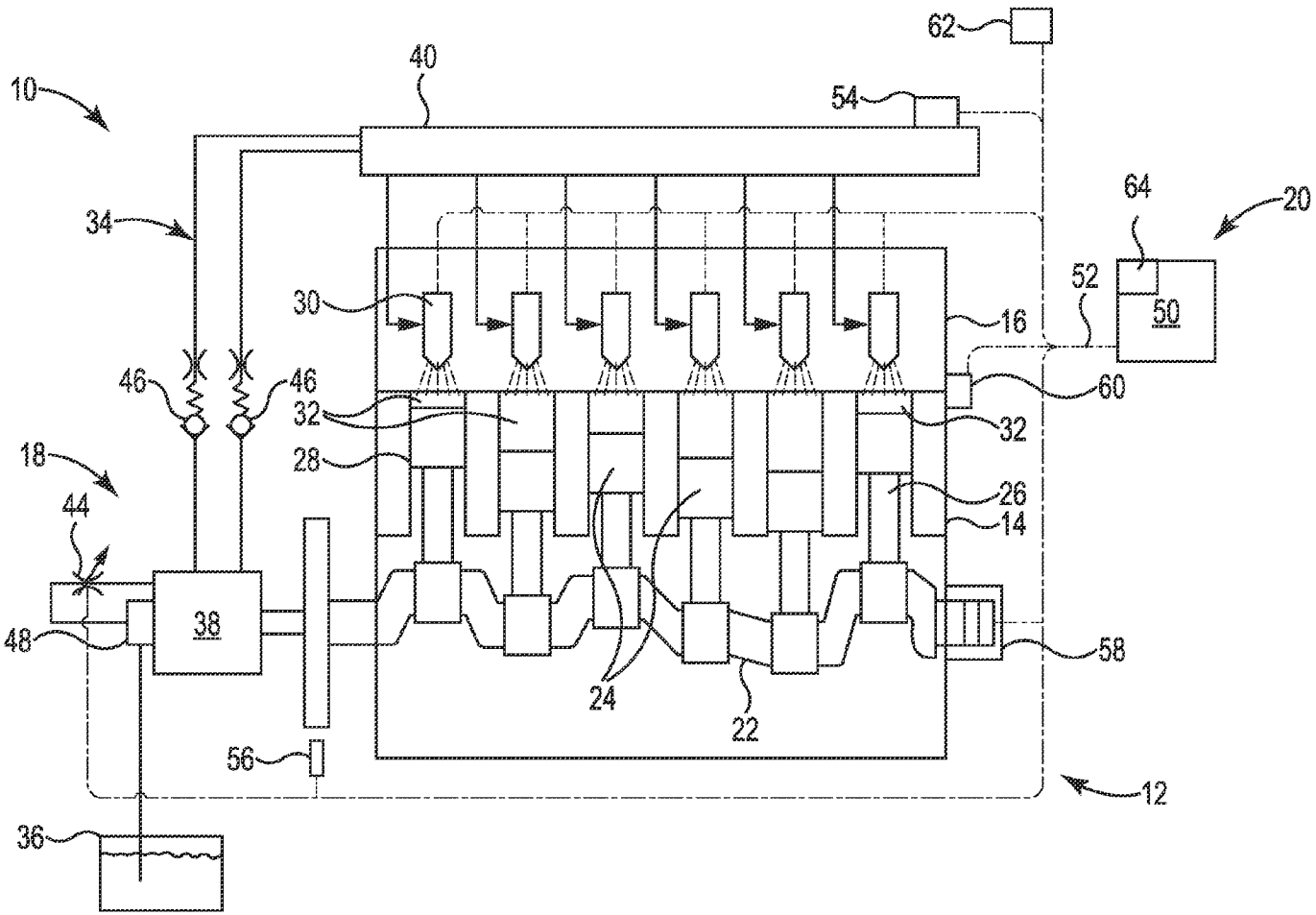
FIG. 1 is a schematic of an internal combustion engine in accordance with some embodiments of the present disclosure.

Referring to FIG. 1, a portion of an internal combustion engine in accordance with an exemplary embodiment of the present disclosure is shown as a simplified schematic and generally indicated at 10. Engine 10 includes an engine body 12, which includes an engine block 14 and a cylinder head 16 attached to engine block 14, a fuel system 18, and a control system 20. Control system 20 receives signals from sensors located on engine 10 and transmits control signals to devices located on engine 10 to control the function of those devices, such as one or more fuel injectors 30. The fuel injectors 30 are tested and characterized prior to installation in engine 10. When each fuel injector 30 is installed into engine 10, the performance characteristics of each fuel injector is loaded into control system 20 as calibration values that permit control system 20 to adjust the operation of each fuel injector to optimize fuel delivery. One challenge with a fuel injector 30 is that its performance changes with time. The originally programmed calibration values, such as the relationship between an on-time and a fuel amount delivered, for each fuel injector 30 lead to less optimal performance of each fuel injector as each fuel injector ages. The system and method of the present disclosure provides the ability to dynamically re-measure the ability of each fuel injector 30 to deliver fuel under specific operating conditions, and the system and method compares the measured fuel delivery to a lookup table of injector on-times. Determining the amount of fuel delivered by a fuel injector 30 while engine 10 is operating is difficult and can lead to significant errors because a fuel rail or accumulator 40 is subject to a significant number of pressure changes during operation as fuel flows into and out from the fuel accumulator, some of which may appear to be noise. The system and method of the present disclosure eliminates these sources of pressure changes and noise by actuating a single fuel injector 30 after engine 10 stops operation, and while sufficient pressure remains in the fuel accumulator 40 to permit proper functioning of the fuel injector. The actuation of a fuel injector 30 causes a pressure drop or decrease in a fuel rail or accumulator 40 that is measured. In some embodiments, the amount of fuel may be measured or indicated, in particular, by the pressure drop of decrease. For example, the system and method uses the pressure drop information to calculate the amount of fuel delivered and to analyze the calculated amount of fuel delivered versus a commanded amount of fuel delivered and to change or "trim" an injector on-time calibration in response to deviations from the commanded amount of fuel delivery. By limiting the injection event to a period after engine 10 has stopped operation, and by using pressure drop information, this system and method are non-intrusive.

Engine body 12 includes a crankshaft 22, a plurality of pistons 24, and a plurality of connecting rods 26. Pistons 24 are positioned for reciprocal movement in a plurality of engine cylinders 28, with one piston positioned in each engine cylinder 28. One connecting rod 26 connects each piston 24 to crankshaft 22. As will be seen, the movement of pistons 24 under the action of a combustion process in engine 10 causes connecting rods 26 to move crankshaft 22.

A plurality of fuel injectors 30 are positioned within cylinder head 16. Each fuel injector 30 is fluidly connected to a combustion chamber 32, each of which is formed by one piston 24, cylinder head 16, and the portion of engine cylinder 28 that extends between a respective piston 24 and cylinder head 16.

Fuel system 18 provides fuel to injectors 30, which is then injected into combustion chambers 32 by the action of fuel injectors 30, forming one or more injection events. Fuel system 18 includes a fuel circuit 34, a fuel tank 36, which contains a fuel, a high-pressure fuel pump 38 positioned along fuel circuit 34 downstream from fuel tank 36, and a fuel rail or accumulator 40 positioned along fuel circuit 34 downstream from high-pressure fuel pump 38. While fuel rail or accumulator 40 is shown as a single unit or element, accumulator 40 may be distributed over a plurality of elements that transmit or receive high-pressure fuel, such as fuel injector(s) 30, high-pressure fuel pump 38, and any lines, passages, tubes, hoses, conduits, and the like that connect high-pressure fuel to the plurality of elements. Fuel system 18 may further include an inlet metering valve 44, positioned along fuel circuit 34 upstream from high-pressure fuel pump 38, and one or more outlet check valves 46, positioned along fuel circuit 34 downstream from high-pressure fuel pump 38 to permit one-way fuel flow from high-pressure fuel pump 38 to fuel accumulator 40. Though not shown, additional elements may be positioned along fuel circuit 34. For example, inlet check valves may be positioned downstream from inlet metering valve 44 and upstream from high-pressure fuel pump 38, or inlet check valves may be incorporated in high-pressure fuel pump 38. Inlet metering valve 44 has the ability to vary or shut off fuel flow to high-pressure fuel pump 38, which thus shuts off fuel flow to fuel accumulator 40. Fuel circuit 34 connects fuel accumulator 40 to fuel injectors 30, which receive fuel from fuel accumulator 40 and then provide controlled amounts of fuel to combustion chambers 32. Fuel system 18 may also include a low-pressure fuel pump 48 positioned along fuel circuit 34 between fuel tank 36 and high-pressure fuel pump 38. Low-pressure fuel pump 48 increases the fuel pressure to a first pressure level prior to fuel flowing into high-pressure fuel pump 38.

Control system 20 may include a controller or control module 50 and a wire harness 52. Many aspects of the disclosure are described in terms of sequences of actions to be performed by elements of a computer system or other hardware capable of executing programmed instructions, for example, a general purpose computer, special purpose computer, workstation, or other programmable data processing apparatus. It will be recognized that in each of the embodiments, the various actions could be performed by specialized circuits (e.g., discrete logic gates interconnected to perform a specialized function), by program instructions, such as logical blocks, program modules etc. being executed by one or more processors (e.g., one or more microprocessor, a central processing unit (CPU), and/or application specific integrated circuit), or by a combination of both. For example, embodiments can be implemented in hardware, firmware, middleware, microcode, or any combination thereof. The instructions can be program code or code segments that perform necessary tasks and can be stored in a non-transitory machine-readable medium such as a storage medium or other storage(s). A code segment may represent a procedure, a function, a subprogram, a program, a routine, a subroutine, a module, a package, a class, or any combination of instructions, data structures, or program statements. A code segment may be coupled to another code segment or a hardware circuit by passing and/or receiving information, data, arguments, parameters, or memory contents.

The non-transitory machine-readable medium can additionally be considered to be embodied within any tangible form of computer readable carrier, such as solid-state memory, magnetic disk, and optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information.

It should be noted that the system of the present disclosure is illustrated and discussed herein as having various modules and units which perform particular functions. It should be understood that these modules and units are merely schematically illustrated based on their function for clarity purposes, and do not necessarily represent specific embodiments. In this regard, these modules, units and other components may be implemented to substantially perform their particular functions explained herein. The various functions of the different components can be combined or segregated as modules in any manner, and can be useful separately or in combination. Input/output or I/O devices or user interfaces including but not limited to keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Control system 20 may also include an accumulator pressure sensor 54, an engine temperature sensor 60, an altitude sensor 62, and a crank angle sensor 64. While sensor 54 is described as being a pressure sensor, sensor 54 may be other devices that may be calibrated to provide a pressure signal that represents fuel pressure, such as a force transducer, strain gauge, or other device. Engine temperature sensor 60 may be positioned to measure a coolant temperature or may be positioned to measure a temperature of engine body 12, including engine block 14 or cylinder head 16. Altitude sensor 62 may be positioned at any location on engine 10 or in another location, such as a vehicle on which engine 10 is mounted, to measure the altitude at which engine 10 is operating. The crank angle sensor 64 may be a toothed wheel sensor 56, a rotary Hall sensor 58, or other type of device capable of measuring the rotational angle of crankshaft 22. Control system 20 uses signals received from accumulator pressure sensor 54 and the crank angle sensor 64 to determine which combustion chamber 32 contains a piston 24 in position to receive fuel. The control system 20 analyzes the signals received from accumulator pressure sensor 54 to determine a pressure drop.

Control module 50 may be an electronic control unit or electronic control module (ECM) that may monitor conditions of engine 10 or an associated vehicle in which engine 10 may be located. Control module 50 may be a single processor, a distributed processor, an electronic equivalent of a processor, or any combination of the aforementioned elements, as well as computer-readable instructions, electronic storage, fixed lookup tables and the like. Control module 50 may include a digital or analog circuit. Control module 50 may connect to certain components of engine 10 by wire harness 52, though such connection may be by other means, including a wireless system. For example, control module 50 may connect to and provide control signals to inlet metering valve 44 and to fuel injectors 30.

When engine 10 is operating, combustion in combustion chambers 32 causes the movement of pistons 24. The movement of pistons 24 causes movement of connecting rods 26, which are drivingly connected to crankshaft 22, and movement of connecting rods 26 causes rotary movement of crankshaft 22. The angle of rotation of crankshaft 22 is measured by engine 10 to aid in timing of combustion events in engine 10 and for other purposes. The angle of rotation of crankshaft 22 may be measured in a plurality of locations, including a main crank pulley (not shown), an engine flywheel (not shown), an engine camshaft (not shown), or on the camshaft itself. Measurement of crankshaft 22 rotation angle may be made with toothed wheel sensor 56, rotary Hall sensor 58, and by other techniques. A signal representing the angle of rotation of crankshaft 22, also called the crank angle, is transmitted from toothed wheel sensor 56, rotary Hall sensor 58, or other device to control system 20.

Crankshaft 22 drives high-pressure fuel pump 38 and low-pressure fuel pump 48. The action of low-pressure fuel pump 48 pulls fuel from fuel tank 36 and moves the fuel along fuel circuit 34 toward inlet metering valve 44. From inlet metering valve 44, fuel flows downstream along fuel circuit 34 through inlet check valves (not shown) to high-pressure fuel pump 38. High-pressure fuel pump 38 moves the fuel downstream along fuel circuit 34 through outlet check valves 46 toward fuel rail or accumulator 40. Inlet metering valve 44 receives control signals from control system 20 and is operable to block fuel flow to high-pressure fuel pump 38. Inlet metering valve 44 may be a proportional valve or may be an on-off valve that is capable of being rapidly modulated between an open and a closed position to adjust the amount of fuel flowing through the valve.

Fuel pressure sensor 54 is connected to fuel accumulator 40 and is capable of detecting or measuring the fuel pressure in fuel accumulator 40. Fuel pressure sensor 54 sends signals indicative of the fuel pressure in fuel accumulator 40 to control system 20. Fuel accumulator 40 is connected to each fuel injector 30. Control system 20 provides control signals to fuel injectors 30 that determines operating parameters for each fuel injector 30, such as the length of time fuel injectors 30 operate and the number of fueling pulses per a firing or injection event period, which determines the amount of fuel delivered by each fuel injector 30.

Figure 2:
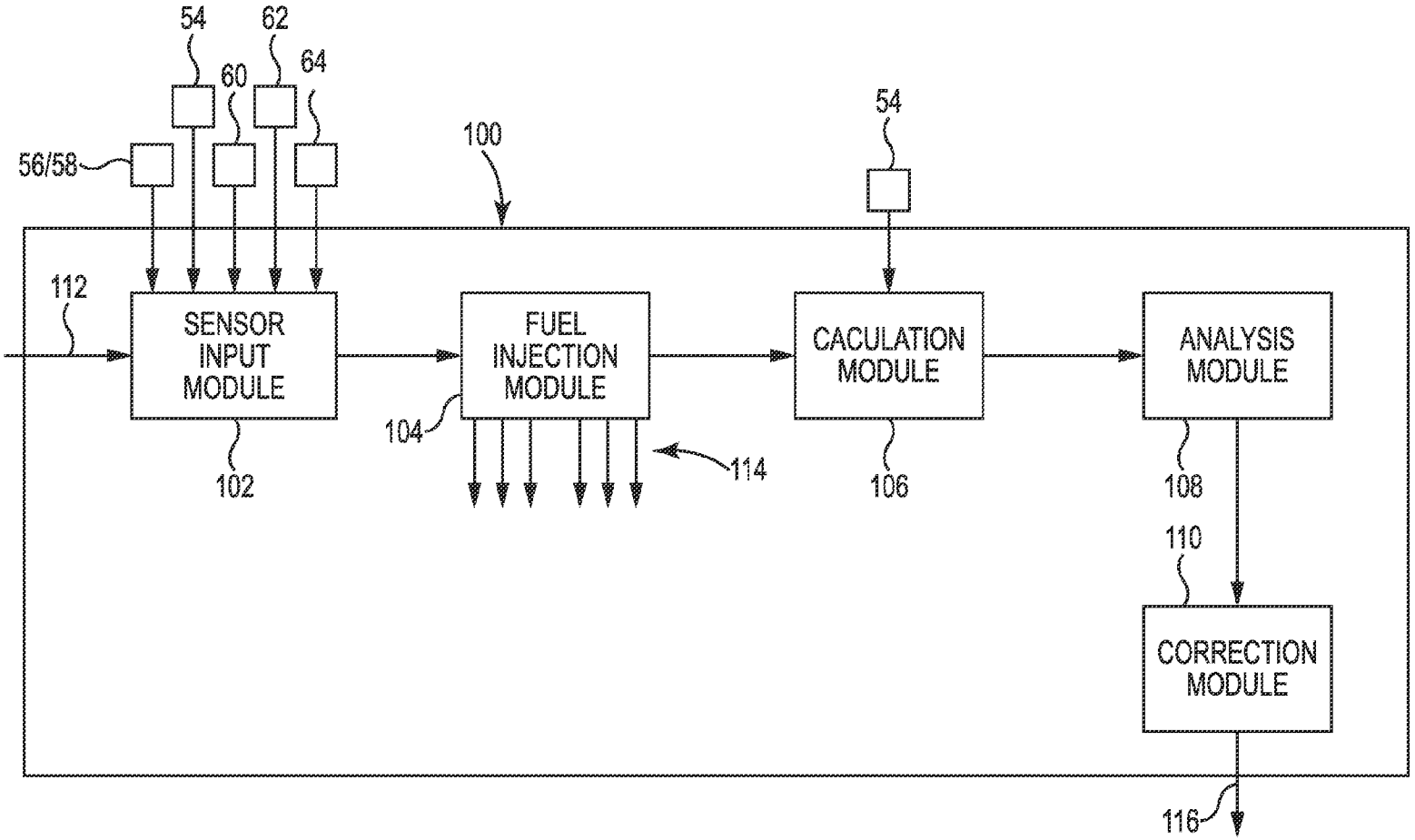
FIG. 2 is a fuel injector on-time calibration module of the engine of FIG. 1 in accordance with some embodiments of the present disclosure.

Referring to FIG. 2, a fuel injector calibration module of control system 20 is shown in accordance with an exemplary embodiment of the present disclosure and generally indicated at 100. Fuel injector calibration module 100 includes a sensor input module 102, a fuel injection module 104, a calculation module 106, an analysis module 108, and a correction module 110. Sensor module 102 receives an engine off or end of engine operation signal 112, which may come from a sensor tied to operation of engine 10 or from elsewhere in control system 20. In an exemplary embodiment, the engine off signal may be received when an ignition key (not shown) is rotated from a "RUN" position to a non-run position, such as "AUX" or "OFF." In another exemplary embodiment, control system 20 may use a signal from the crank angle sensor 64 to determine that engine 10 has ceased operating. Control system 20 then generates and transmits the engine off signal 112 to sensor input module 102. Sensor module 102 also receives signals from the crank angle sensor 64, such as, but not limited to, toothed wheel sensor 56 or rotary hall sensor 58, fuel rail or accumulator pressure sensor 54, engine temperature sensor 60, and altitude sensor 62. After sensor module 102 receives engine off signal 112, sensor module 102 transmits data received from the crank angle sensor 64, pressure sensor 54, engine temperature sensor 60, and altitude sensor 62 to fuel injection module 104.

Fuel injection module 104 uses the data provided by sensor input module 102 to determine which piston 24 is in a position that would normally receive fuel from an associated fuel injector 30. Once fuel injection module 104 determines which piston is in the position to receive fuel, fuel injection module 104 transmits a single fuel injector actuation signal 114 to one fuel injector 30 to initiate a fuel injection event, which causes fuel to flow from fuel accumulator 40 through fuel injector 30 into a respective combustion chamber 32. The flow of fuel from fuel accumulator 40 changes the pressure decay profile in fuel accumulator 40, described further hereinbelow. Once the fuel injection event has ended, fuel injection module 104 transmits the sensor information provided by sensor input module 102 to calculation module 106.

Calculation module 106 receives sensor inputs from fuel injection module 104 and receives pressure signals from accumulator pressure sensor 54. Calculation module 106 uses the sensor inputs, particularly pressure signals from pressure sensor 54 before and after the injection event, to calculate the amount of fuel delivered by fuel injector 30. Once the amount of fuel delivered by fuel injector 30 has been calculated, the fuel amount delivered by a specific fuel injector 30 is transmitted to analysis module 108.

Analysis module 108 receives the calculated amount of fuel delivered and the particular fuel injector 30 associated with the fuel delivered. The amount of fuel delivered is compared to the amount of fuel commanded to be delivered for the specific fuel injector on-time stored in a lookup table to determine whether an associated fuel injector 30 is providing a different amount of fuel as compared to the amount of fuel commanded to be delivered. Analysis module 108 then analyzes the deviation from the lookup table values during previous injection events after the stop of engine operation to perform a trend analysis on the deviation in the amount of fuel injected, thus reducing noise in the calculation. If the analysis of the current and previously calculated fuel amounts delivered is different from the amount that should have been delivered based on the on-time recorded in the lookup table, then analysis module 108 provides the information to correction module 110. If analysis module 108 determines that no correction is required, then the process of fuel injector calibration module 100 stops at analysis module 108 or provides information to correction module 110 indicating that no correction is to be made.

Correction module 110 receives a correction factor from analysis module 108 and fuel injector 30 associated with the correction factor. Correction module 110 adjusts the on-time calibration for associated fuel injector 30 and transmits a calibration signal 116 representing the modified fuel injector on-time to the lookup table, where the value will be stored for future injection events, and thus ending the process of fuel injector calibration module 100. In some embodiments, the correction factor is zero based on information indicating that no correction is to be made.

Figure 3:
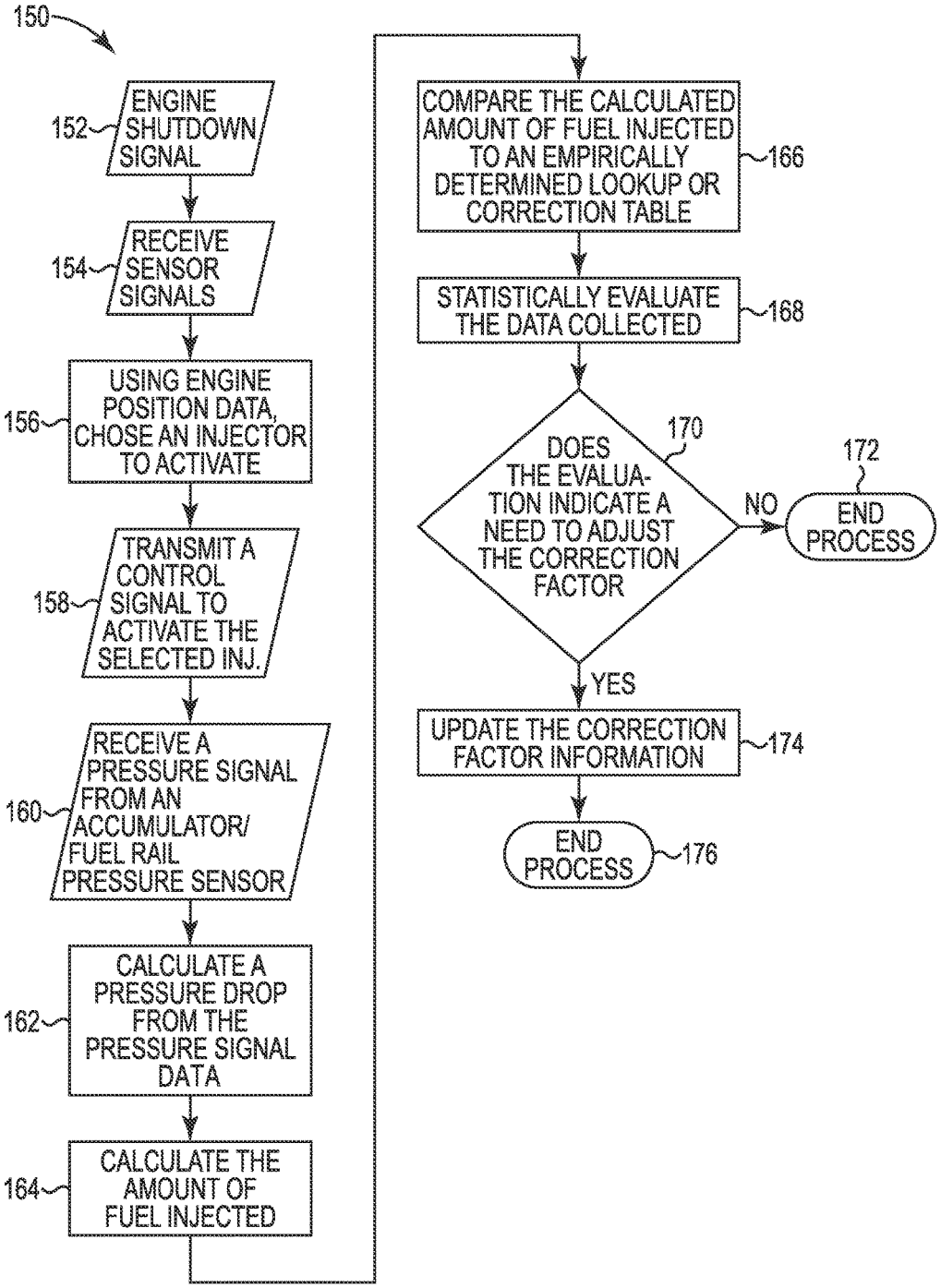
FIG. 3 is a process flow diagram for a fuel injector calibration process of the fuel injector calibration module of FIG. 2 in accordance with some embodiments of the present disclosure.

Referring to FIG. 3, a process flow diagram for a fuel injector calibration process of fuel injector calibration module 100 in accordance with an exemplary embodiment of the present disclosure is shown and generally indicated at 150. Fuel injector calibration process 150 is included at least partially in the modules of fuel injector calibration module 100. Calibration process 150 begins at a process 152, which is the receipt of the signal indicating engine 10 has ceased operation. Control is then passed to a sensor input process 154, where signals from one or more sensors are received, such as the crankshaft angle sensor, accumulator pressure sensor 54, engine temperature sensor 60, and altitude sensor 62. Control is then passed to a fuel injector selection process 156, which uses the sensor signal inputs received from sensor input process 154 to determine which piston 24 is in position to receive injected fuel, which then determines which fuel injector 30 should be actuated. The information regarding which fuel injector 30 requires actuation is sent to a fuel injector actuation process 158.

In fuel injector actuation process 158, signals are transmitted to fuel injector 30 determined by fuel injector selection process 156 to initiate a fuel injection event. The fuel injection event begins with movement of a needle or nozzle valve element (not shown) to open one or more injector orifices to permit fuel to flow into associated combustion chamber 32, and ends when the needle or nozzle valve element blocks fuel flow through the one or more fuel injector orifices. At the end of the injection event, control passes to a pressure sensor signal process 160.

Pressure sensor signal process 160 receives signals from accumulator pressure sensor 54, which is provided, along with pressure information received from input process 154, to a pressure drop or decrease calculation process 162, where a pressure drop in fuel accumulator 40 due to the fuel injector event is calculated or determined. The pressure drop information is provided to a fuel calculation process 164, where the pressure drop is used to calculate the amount of fuel delivered by fuel injector 30. The calculated amount of fuel delivered and the position of fuel injector 30 that delivered the fuel is provided to a comparison process 166, where the calculated amount of fuel is compared with the amount of fuel that should have been delivered using the injector on-time stored in a lookup table to determine a deviation from a calibration value. The deviation information is provided to a statistical process 168.

In statistical process 168, the fuel deviations over a plurality of previous injection events, in combination with the current event, is analyzed to determine whether a change to an injector calibration value is desirable. For example, if the amount of fuel delivered is determined or calculated to be consistently 5% lower than the amount actually commanded, using the fuel injector on-time from the lookup table, then statistical process 168 indicates the need to make a change to a decision process 170. If a change to a calibration value is not required, then control moves to a process 172, which terminates or ends fuel calibration process 150. If a change to a calibration value is required, control passes to an update or change process 174. Change process 174 takes the information provided by statistical process 168 and updates the fuel injector on-time in the lookup table for future fuel injection events. Once the lookup table has been updated, fuel calibration process 150 ends with a termination process 176.

While the processes described above discuss analyzing deviations in fuel delivery, other approaches to analyzing the fuel delivery information may be used. For example, calculated fuel delivery may be statistically analyzed over a series of fuel injection events, and the statistically analyzed fuel delivery may then be compared to the delivery expected using the on-time from the lookup table. Other approaches for statistically analyzing the fuel delivery data may be used and thus the specific analytical approach is illustrative only.

Figure 4:
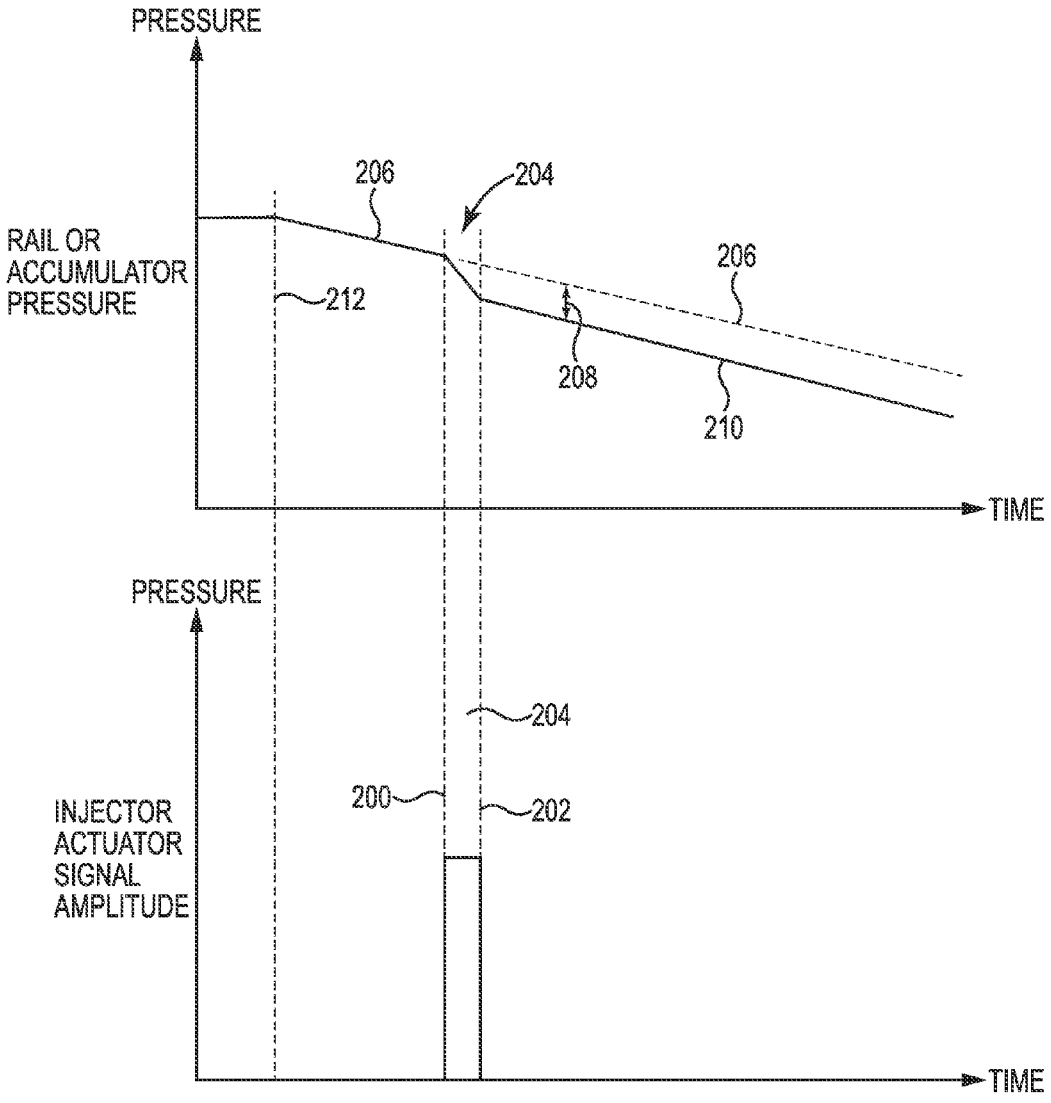
FIG. 4 is a graph showing a fuel injector control signal and data acquired after operation of the engine of FIG. 1 has stopped in accordance with some embodiments of the present disclosure.

Referring to FIG. 4, graphs representing a fuel injector actuation signal corresponding to a fuel injection event and an associated pressure drop in fuel accumulator 40 are shown. The lower graph of FIG. 4 shows the duration of a fuel injection actuation signal, which approximately correlates with the fuel injection event, beginning with a start of injection 200 and finishing with an end of injection 202, defining a fuel injection event 204. Fuel injection event 204 may be for a fixed length of time, for example about 160 microseconds, or for a fixed change in fuel pressure, for example about 70 Bar. The upper graph in FIG. 4 shows the pressure signal from accumulator pressure sensor 54, which shows a pressure decay curve 206 to be expected when high-pressure fuel pump 38 stops operating, which occurs when engine 10 stops operating at 212 (i.e. engine shutdown). During fuel injection event 204, pressure decreases in fuel accumulator 40 due to the fuel flowing into combustion chamber 32, which can be seen as a fuel injection pressure drop 208, which then defines a new pressure decay curve 210. Pressure drop 208 may be used to calculate the amount of fuel delivered by associated fuel injector 30 without the noise induced by operation of high-pressure fuel pump 38 and the shock waves induced in fuel system 18 by operation of high-pressure fuel pump 38 and the other fuel injectors 30.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A method of calibrating fuel injectors of an engine, comprising:

providing a control system including an engine shutdown sensor, an accumulator pressure sensor, and at least one processor having a non-transitory computer-readable medium configured to receive a plurality of instructions;

receiving, by the processor, an engine shutdown value indicating that the engine is shut down from the engine shutdown sensor;

providing a fuel injection value, from the processor to at least one of the fuel injectors, to initiate a single fuel injection event for the one of the fuel injectors corresponding to a cylinder in response to the engine shutdown value when the engine is shut down;

receiving, by the processor, a pressure value, from the accumulator pressure sensor, representing a fuel pressure over a period of time, which includes the fuel injection event;

calculating, by the processor, an amount of fuel actually injected in response to the pressure value;

producing, by the processor, a deviation value in response to the amount of fuel and a commanded amount of fuel; and determining, by the processor, a correction factor for the injector in response to the deviation value.

2. The method of claim 1, further including operating the fuel injector in response to the correction factor.

3. The method of claim 2, wherein determining the correction factor is in response to a statistical analysis of fuel injection events by the processor.

4. The method of claim 1, further including receiving, by the processor, sensor information, and determining, by the processor, in response to the sensor information which fuel injector to provide the fuel injection value.

5. The method of claim 4, further wherein the sensor information includes at least one of a fuel pressure, an engine temperature, an altitude, and a crank angle.

6. The method of claim 1, further including producing, by the processor, the deviation value in response to a trend analysis including the amount of fuel delivered and a previous amount of fuel delivered.

7. The method of claim 1, wherein the fuel injection value is provided, by the processor, while sufficient pressure remains in a fuel accumulator to permit actuation of the fuel injector.

8. A control system, comprising:

a memory configured to store a commanded amount of fuel for a fuel injector corresponding to a cylinder; and an analysis module coupled to the memory and configured to:

detect an engine shutdown value indicating that the engine is shut down;

determine a deviation value in response to the commanded amount of fuel and an amount of fuel delivered during an injection event initiated in response to the engine shutdown value when the engine is shut down;

determine a correction factor in response to the deviation value; and operate the fuel injector in response to the correction factor.

9. The control system of claim 8, wherein the analysis module is further configured to:

produce the deviation in response to a trend analysis including the amount of fuel delivered and a previous amount of fuel delivered stored in the memory.

10. The control system of claim 8, including a correction module coupled to the analysis module, the correction module configured to:

receive the correction factor;

produce a modified on-time calibration for the fuel injector; and provide a calibration value representing the modified on-time calibration to a corresponding lookup table.

11. The control system of claim 10, further comprising a calculation module coupled to the analysis module, the calculation module configured to:

receive pressure information directly or indirectly from an accumulator pressure sensor;

calculate an amount of fuel delivered by the fuel injector to the cylinder; and provide the amount of fuel.

12. The control system of claim 11, further including a fuel injection module coupled to the calculation module and a set of fuel injectors corresponding to a set of cylinders, the fuel injection module configured to:

receive sensor information, including piston position information;

determine the cylinder for receiving fuel in response to the piston position information; and provide a fuel injection value to the fuel injector corresponding to the cylinder.

13. The control system of claim 12, further including a sensor input module coupled to the fuel injection module and at least one sensor, the sensor input module configured to:

receive the engine shutdown value;

receive sensor information from the at least one sensor, including piston position information for a set of cylinders; and provide the engine shutdown value and the sensor information.

14. The control system of claim 13, wherein the at least one sensor includes at least one of a fuel pressure sensor, an altitude sensor, and a crank angle sensor, wherein the piston position information is determined in response to information from the crank angle sensor.

15. The control system of claim 11, wherein the pressure information represents a pressure decay curve in a fuel accumulator in fluid communication with a fuel pump.

16. The control system of claim 15, further including indicating that the fuel pump has been shutdown such that noise and pressure changes in the fuel accumulator due to the operation of the fuel pump is reduced in the pressure value.

17. An engine system, comprising:

an engine including an engine block having a set of cylinders;

a fuel injection system including a fuel pump, a fuel accumulator, and a set of fuel injectors in fluid communication with the fuel accumulator, each fuel injector configured to inject fuel into a corresponding cylinder; and means for adjusting an on-time value of a fuel injector in response to a deviation between an amount of fuel and a commanded amount of fuel, wherein the means for adjusting the on-time value of the fuel injector is configured to detect an engine shutdown value indicating that the engine is shut down and error in the amount of fuel caused by an operating fuel pump is mitigated during the engine shutdown.

18. The engine system of claim 17, wherein the means for adjusting an on-time value of a fuel injector is configured to calculate an amount of fuel injected in response to a change in pressure in the fuel accumulator.

19. The engine system of claim 18, wherein the means for adjusting an on-time value of a fuel injector is configured to calculate the amount of fuel in response to a pressure measurement made when the fuel pump is not in operation.

20. A method of calibrating fuel injectors of an engine, comprising:

receiving an engine shutdown value indicating that the engine is shut down;

providing a fuel injection value to initiate a single fuel injection event for a fuel injector corresponding to a cylinder in response to the engine shutdown value when the engine is shut down;

receiving a pressure value representing a fuel pressure over a period of time, which includes the fuel injection event;

calculating an amount of fuel actually injected in response to the pressure value;

producing a deviation value in response to the amount of fuel and a commanded amount of fuel;

determining a correction factor for the injector in response to the deviation value; and operating the fuel injector in response to the correction factor.

21. The method of claim 20, further including receiving sensor information, and determining in response to the sensor information which fuel injector to provide the fuel injection value.

22. The method of claim 21, further wherein the sensor information includes at least one of a fuel pressure, an engine temperature, an altitude, and a crank angle.

23. The method of claim 20, further including producing the deviation value in response to a trend analysis including the amount of fuel delivered and a previous amount of fuel delivered.

24. The method of claim 20, wherein the fuel injection value is provided while sufficient pressure remains in a fuel accumulator to permit actuation of the fuel injector.

* * * * *